US006062387A

United States Patent [19]

Chen

[11] Patent Number: 6,062,387

[45] Date of Patent: May 16, 2000

[54] LOOSE-LEAF CARD HOLDER ADAPTED FOR HOLDING CARDS THEREIN

[76] Inventor: Cheng-Sung Chen, No. 380, Chung-Hua Rd., Tou-Liu City, Yunlin Hsien, Taiwan

[21] Appl. No.: 09/404,711

[22] Filed: Sep. 24, 1999

[51] Int. Cl.[7] ..... B65D 85/00

[52] U.S. Cl. ..... 206/455; 206/776; 281/20

[58] Field of Search ..... 206/425, 454, 206/455, 769, 771, 776, 778; 281/15.1, 20, 29, 31, 35

[56] References Cited

U.S. PATENT DOCUMENTS

| | | | |
|---|---|---|---|
| 2,630,122 | 3/1953 | Amberg | 281/20 |
| 5,114,009 | 5/1992 | Johnston | 206/425 |
| 5,489,120 | 2/1996 | Thornsburg | 281/29 |
| 5,806,677 | 9/1998 | Storti | 206/455 X |

*Primary Examiner*—Jacob K. Ackun

*Attorney, Agent, or Firm*—Foley & Lardner

[57] ABSTRACT

A loose-leaf card holder is adapted for holding a plurality of cards therein, and includes a holder body and a pair of note-writing flaps. The holder body includes a backing sheet and a front sheet, which are made from a transparent plastic fusible material. The front sheet has lateral edges and a first transverse edge connected sealingly to one surface of the backing sheet such that the front sheet and the backing sheet cooperatively form a pouch unit. The front sheet is further connected to the backing sheet along a heat-sealed seam unit that divides the pouch unit into at least two least card receiving spaces. A second transverse edge of the front sheet further cooperates with the backing sheet to form each of the card receiving spaces with an open access end. The note-writing flaps are connected respectively to the holder body at one pair of lateral and transverse sides of the holder body. Each note-writing flap has a note writing portion adapted for writing notes thereon, and a connecting portion that extends from the note writing portion and that is connected to the holder body. One of the note-writing flaps further has a binding portion that is formed with a set of binding holes.

5 Claims, 8 Drawing Sheets

LOOSE-LEAF CARD HOLDER ADAPTED FOR HOLDING CARDS THEREIN

BACKGROUND OF THE INVENTION

1. Field of the Invention

The invention relates to a card holder for holding cards, such as baseball cards and the like, more particularly to a loose-leaf card holder having flaps that are adapted for writing thereon.

2. Description of the Related Art

Sports cards, such as baseball cards, generally have one side printed with a picture of a sports player, and the opposite side printed with information, such as game statistics, of the sports player. Collectors usually store sports cards in loose-leaf card holders that are bound together in a card storage book. Referring to FIGS. 1 and 2, a conventional loose-leaf card holder 1 is adapted for holding a plurality of sports cards 10 therein, and includes a holder body having a transparent plastic backing sheet 12 and three transparent plastic front sheets 11 connected sealingly to the backing sheet 12 at lateral side and transverse bottom edges thereof such that the front sheets 11 and the backing sheet 12 cooperate to form three pouch units. The front sheets 11 are further connected to the backing sheet 12 along heat-sealed seams 111 that are transverse to the bottom edges and that divide each pouch unit into a row of three card receiving spaces 13. The top edges of the front sheets 11 further cooperate with the backing sheet 12 to form each of the card receiving spaces 13 with an open access end 14 such that the sports cards 10 can be inserted into the card receiving spaces 13 via the open access ends 14. A binding portion 121 is formed integrally with and extends from one lateral side edge of the backing sheet 12. The binding portion 121 is formed with a set of binding holes 122 for mounting the loose-leaf card holder 1 in a card storage book (not shown). Because the front and backing sheets 11, 12 are transparent, the two sides of the sports cards 10 are visible when the latter are stored in the loose-leaf card holder 1.

Collectors usually need to write down notes pertinent to the sports cards 10. If the notes are written directly on the sports cards 10, the value and appearance of the latter will be adversely affected. However, the conventional loose-leaf card holder 1 is not provided with any facility for writing down such notes thereon. If the notes are written directly on the front or backing sheets 11, 12, viewing of the sports cards 10 and orderliness of the card storage book will be adversely affected.

FIGS. 3 and 4 illustrate another conventional loose-leaf card holder 2 that is adapted for holding a plurality of sports cards 25 therein. The loose-leaf card holder 2 includes a transparent rectangular plastic holder bag body 21 having three closed sides and an open side. A paper partition sheet 22 is inserted into the holder bag body 21 via the open side of the latter, and has an edge portion that extends out of the open side of the holder bag body 21 and that serves as a note writing flap 221. In order to form the holder bag body 21 with a column of three card receiving spaces 24 on opposite sides of the partition sheet 22, the partition sheet 22 is formed with upper and lower sets of holes 23 therethrough. The front and back sheets of the holder bag body 21 are joined together by heat-sealing at positions registered with the holes 23, thus resulting in the card receiving spaces 24 for receiving the sports cards 25.

While the flap 221 permits a collector to write down notes pertinent to the sports cards 25 thereon, the non-transparent partition sheet 22 does not permit viewing of the two sides of the sports cards 25 while the latter are stored in the loose-leaf card holder 2.

SUMMARY OF THE INVENTION

Therefore, the object of the present invention is to provide a loose-leaf card holder adapted for holding cards therein, the loose-leaf card holder permitting viewing of opposite sides of the cards while the latter are stored therein, and having note-writing flaps that are adapted for writing thereon.

According to the present invention, a loose-leaf card holder is adapted for holding a plurality of cards therein, and comprises:

a holder body having a pair of lateral sides and a pair of transverse sides, and including a backing sheet and at least one front sheet, the backing sheet and the front sheet being made from a transparent plastic fusible material, the front sheet having opposite transverse edges and opposite lateral edges, the lateral edges and a first one of the transverse edges being connected sealingly to one surface of the backing sheet such that the front sheet and the backing sheet cooperatively form a pouch unit, the front sheet being further connected to the backing sheet along a heat-sealed seam unit that is transverse to the transverse edges and that divides the pouch unit into at least two least card receiving spaces, a second one of the transverse edges of the front sheet further cooperating with the backing sheet to form each of the card receiving spaces with an open access end such that the cards can be inserted into the card receiving spaces via the open access ends; and first and second note-writing flaps connected respectively to the holder body at ore of the pairs of lateral and transverse sides of the holder body, each of the first and second note-writing flaps having a note writing portion adapted for writing notes thereon, and a connecting portion that extends from the note writing portion and that is connected to the holder body, the first note-writing flap further having a binding portion that extends from the note writing portion in a direction opposite to the connecting portion thereof and that is formed with a set of binding holes.

Preferably, the first and second note-writing flaps are made from a plastic synthetic paper material and are connected sealingly to the holder body.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
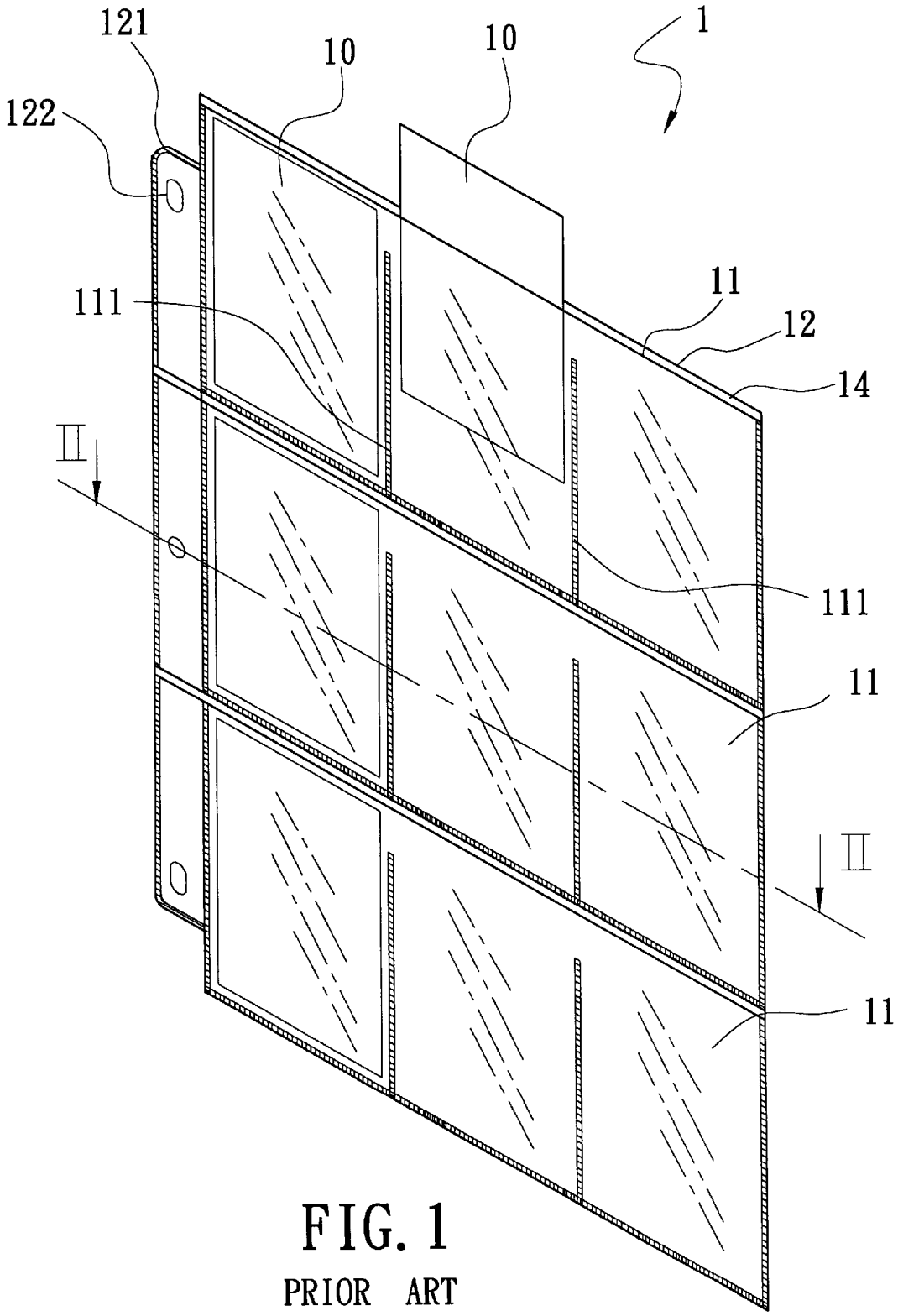
FIG. 1 PRIOR ART
FIG. 1 is a perspective view of a conventional loose-leaf card holder that is adapted for holding cards therein.
Figure 2:
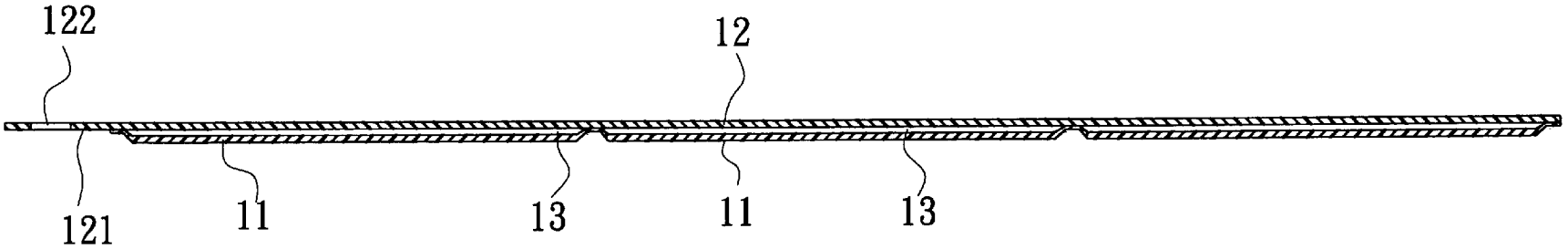
FIG. 2 PRIOR ART
FIG. 2 is a sectional view of the conventional loose-leaf card holder, taken along line II—II of FIG. 1.
Figure 3:
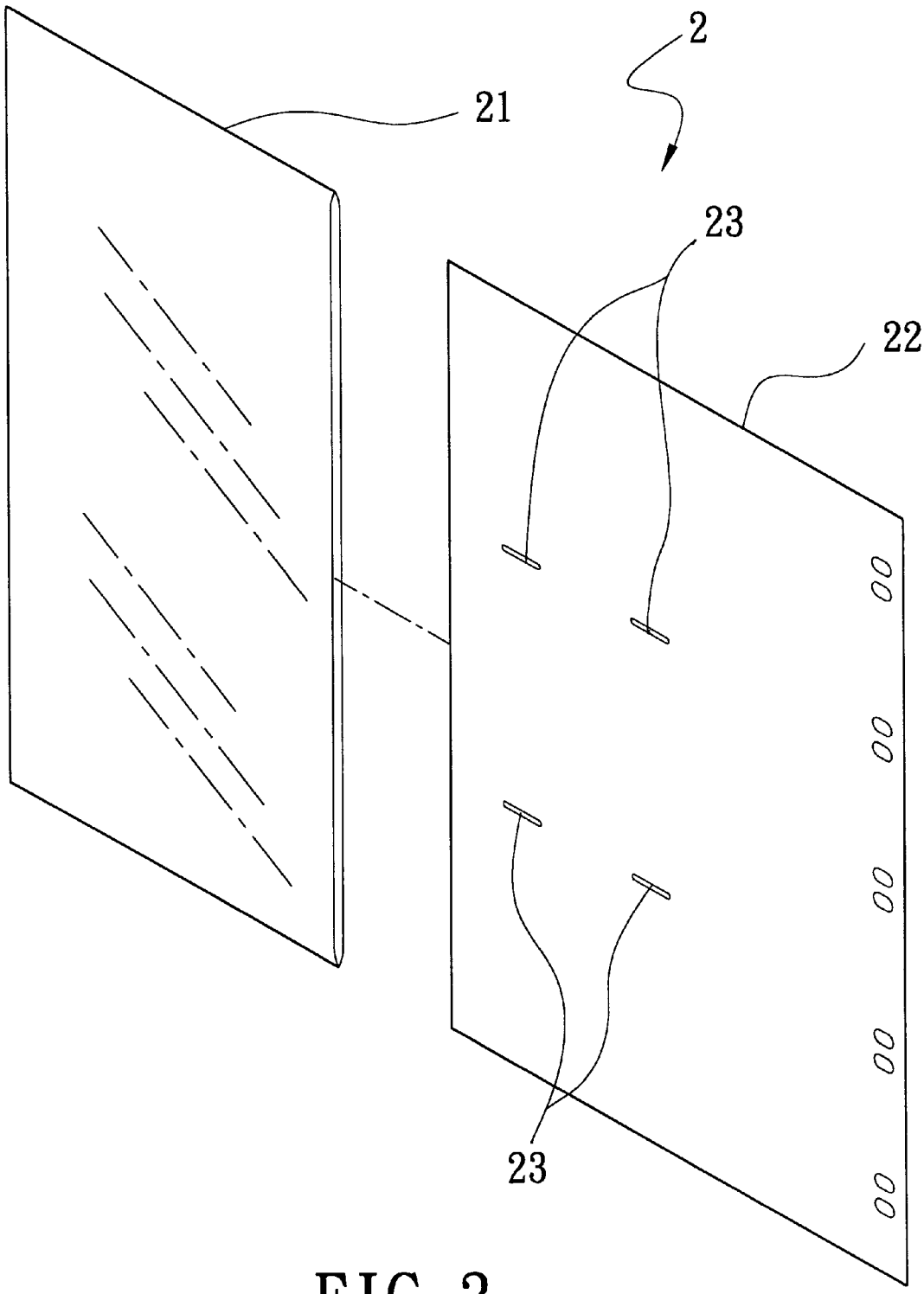
FIG. 3 PRIOR ART
FIG. 3 is an exploded perspective view of another conventional loose-leaf card holder that is adapted for holding cards therein.
Figure 4:
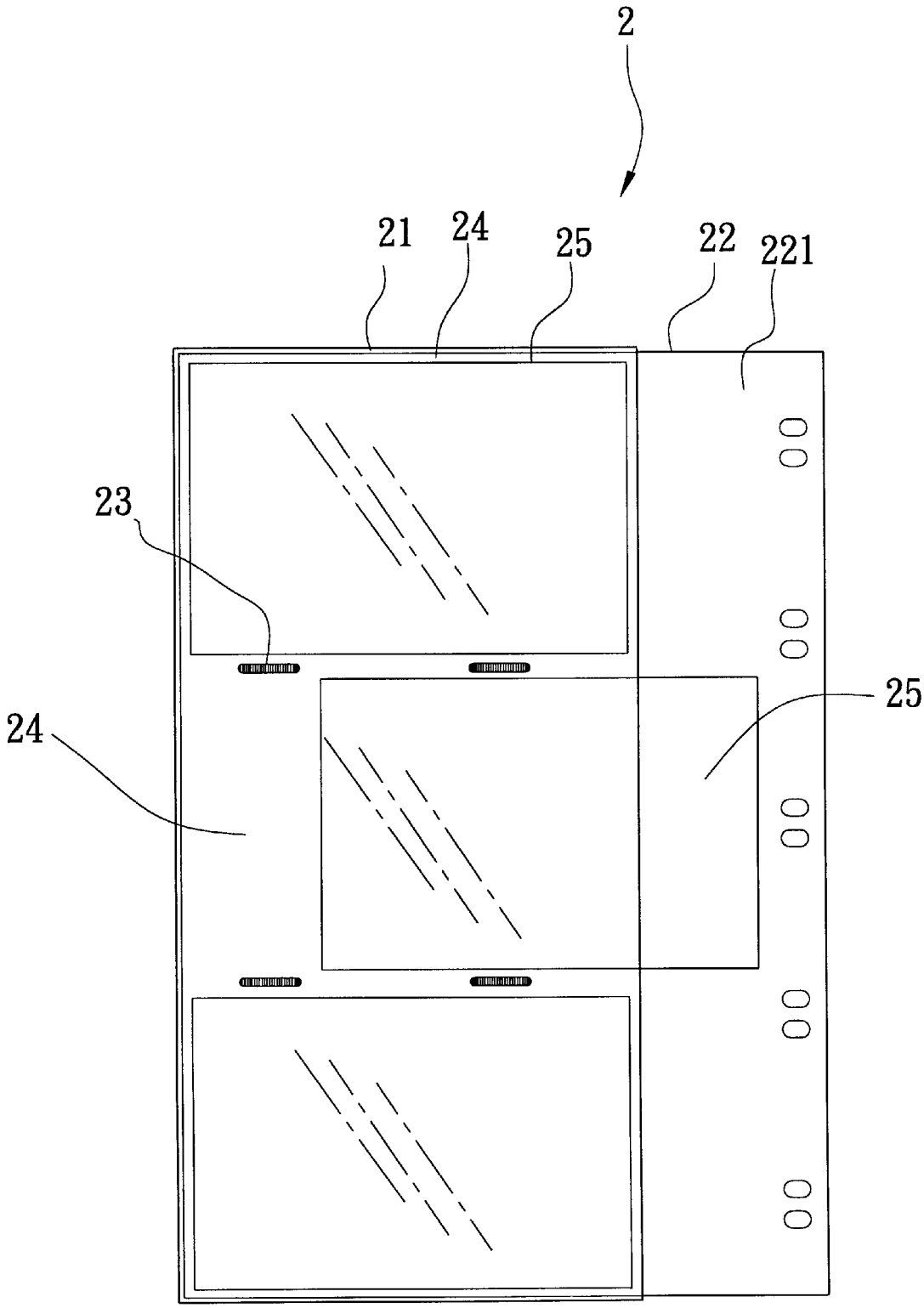
FIG. 4 PRIOR ART
FIG. 4 is a schematic view illustrating the conventional loose-leaf card holder of FIG. 3.
Figure 5:
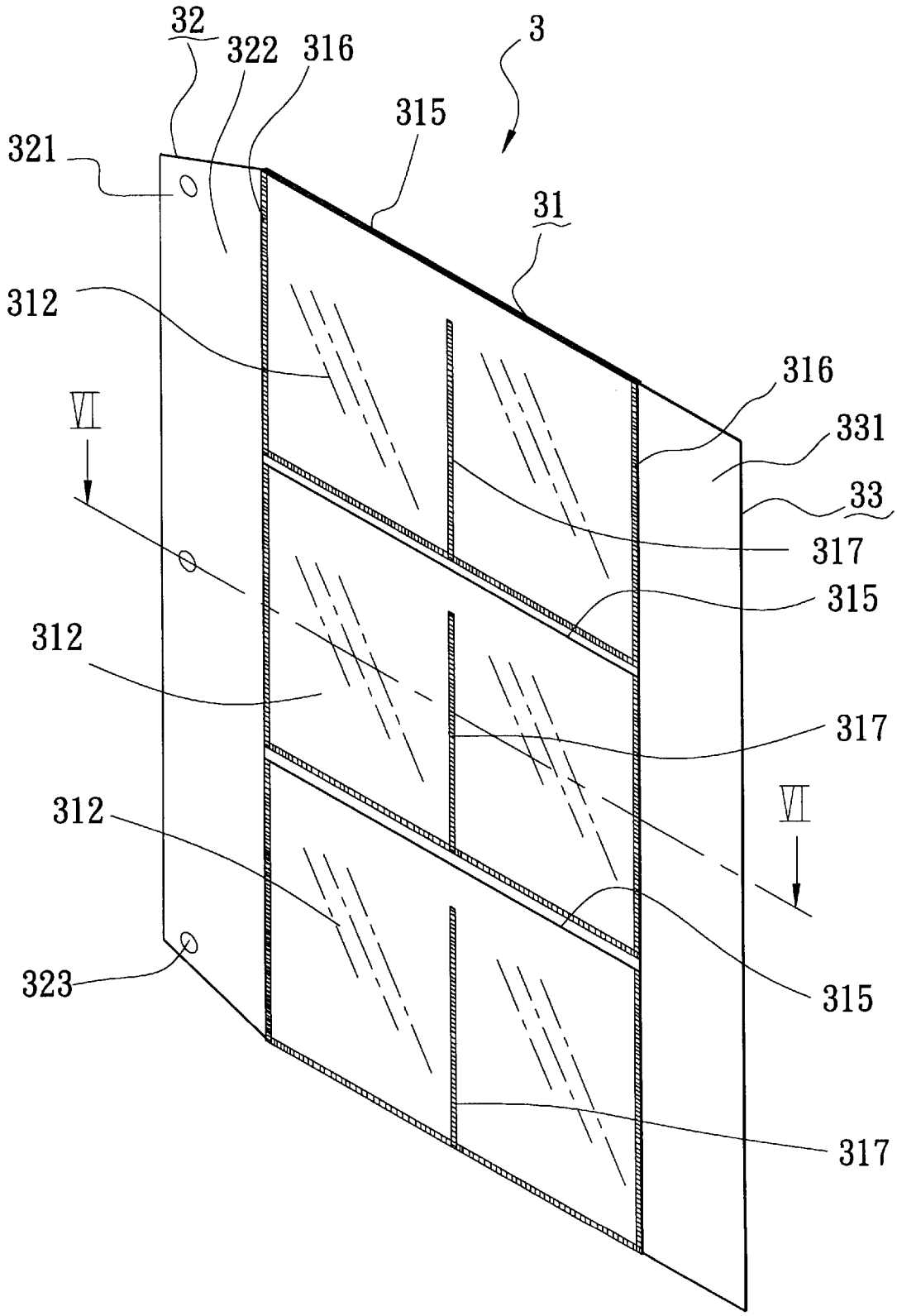
FIG. 5 is a perspective view illustrating the first preferred embodiment of a loose-leaf card holder according to the present invention.
Figure 6:
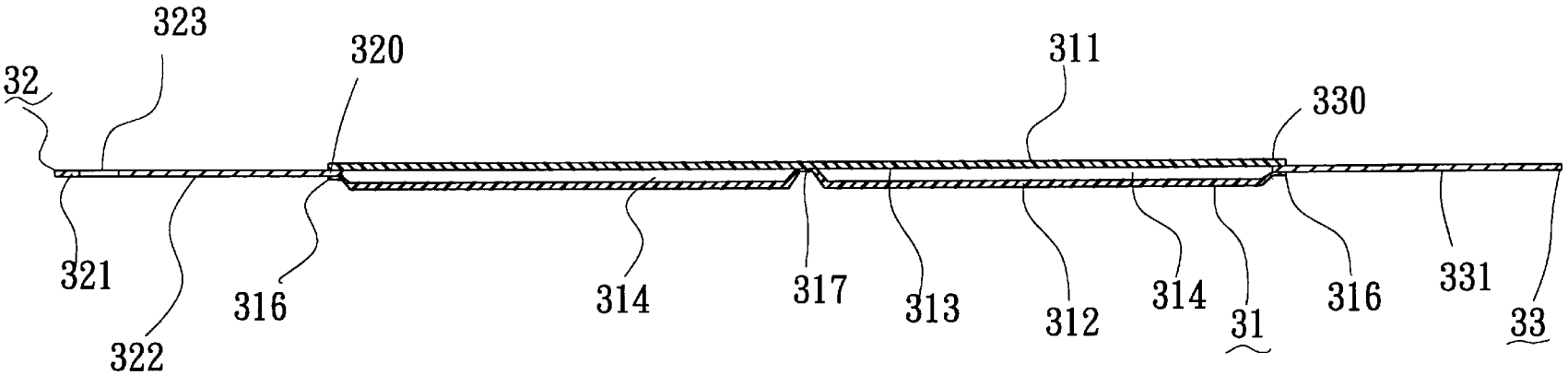
FIG. 6 is a sectional view of the first preferred embodiment, taken along line VI—VI of FIG. 5.
Figure 7:
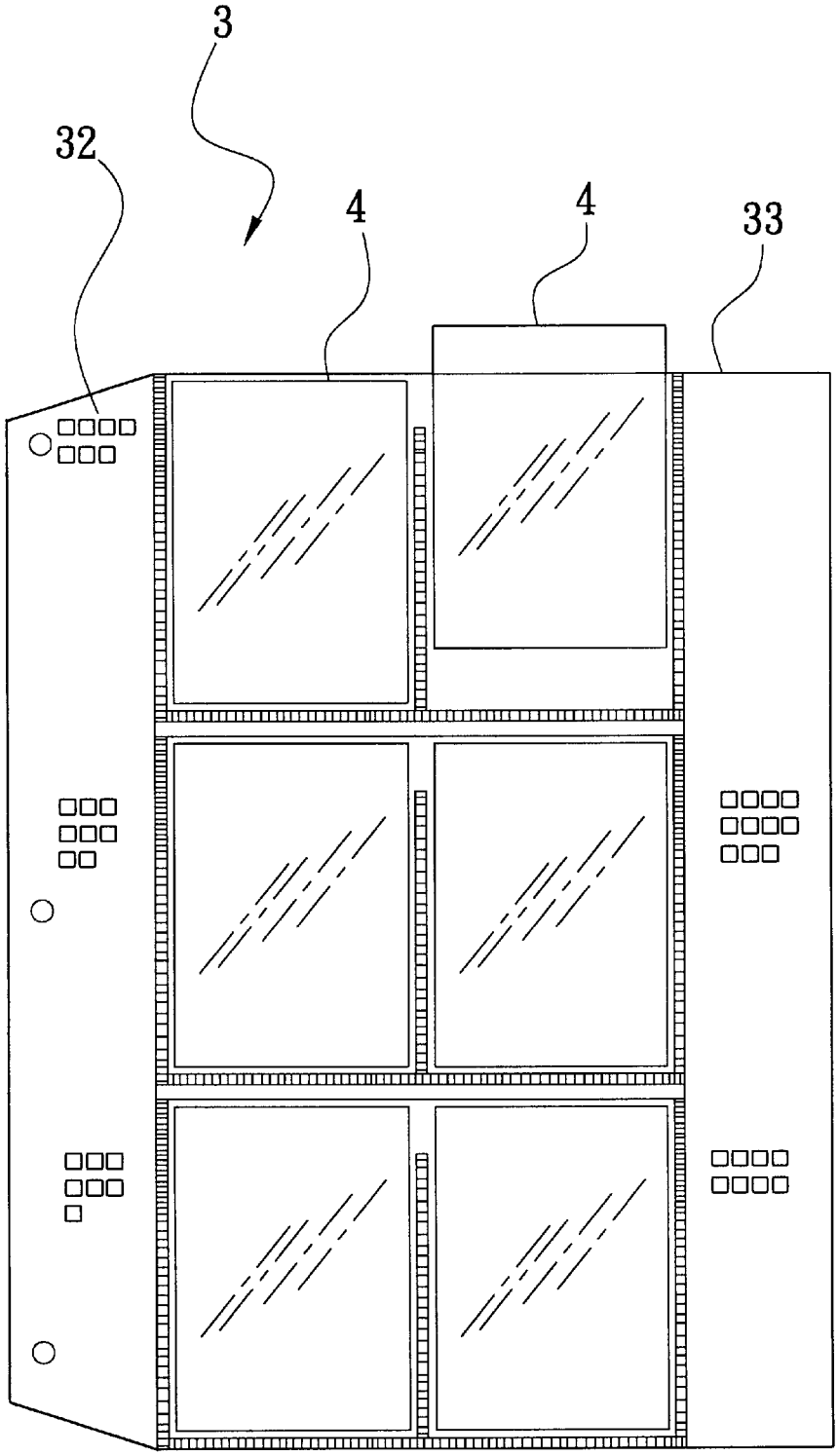
FIG. 7 is a schematic view illustrating the first preferred embodiment in a state of use.

Referring to FIGS. 5, 6 and 7, the first preferred embodiment of a loose-leaf card holder 3 according to the present invention is adapted for holding a plurality of cards 4 (see FIG. 7), such as sports cards, and is adapted to be bound together with other loose-leaf card holders 3 in a card storage book (not shown). The loose-leaf card holder 3 comprises a holder body 31 and left and right note writing flaps 32, 33 connected to lateral left and right sides 316 of the holder body 31.

The holder body 31 includes a backing sheet 311 and three front sheets 312. The backing and front sheets 311, 312 are made from a transparent plastic fusible material, such as polypropylene. Each of the front sheets 312 has a transverse bottom edge and lateral left and right edges connected sealingly to one surface 313 of the backing sheet 311 such that each front sheet 312 cooperates with the backing sheet 311 to form a pouch unit. Each front sheet 312 is further connected to the backing sheet 311 along a heat-sealed seam 317 that is transverse to the bottom edge and that divides the pouch unit into a pair of card receiving spaces 314. The transverse top edges of the front sheets 312 cooperate with the backing sheet 311 to form each of the card receiving spaces 314 with an open access end 315 such that the cards 4 can be inserted into the card receiving space 314 via the open access ends 315, as shown in FIG. 7.

Each of the note writing flaps 32, 33 is made from a plastic synthetic paper material, such as polypropylene, and is adapted for writing notes thereon. The left note writing flap 32 has a connecting portion joined to the left side 316 of the holder body 31, a note writing portion 322 that extends leftward from the connecting portion 320 and that is adapted for writing notes thereon, and a binding portion 321 that extends leftward from the note writing portion 322 and that is formed with a set of binding holes 323 so as to be adapted for binding the loose-leaf card holder 3 to a card storage book (not shown). The right note writing flap 33 has a connecting portion 330 joined to the right side 316 of the holder body 31, and a note writing portion 331 that extends rightward from the connecting portion 330 and that is adapted for writing notes thereon. In this embodiment, the connecting portion 320 of the left note writing flap 32 is disposed between and is heat-sealed to the lateral left edges of the backing sheet 311 and the front sheets 312, whereas the connecting portion 330 of the right note writing flap 33 is disposed between and is heat-sealed to the lateral right edges of the backing sheet 311 and the front sheets 312.

By virtue of the note writing flaps 32, 33, the user can write down notes that are pertinent to the cards 4 in the card receiving spaces 314 on the note writing portions 322, 331. In addition, because the backing and front sheets 311, 312 are transparent, the two sides of the cards 4 are visible when the latter are stored in the loose-leaf card holder 3.

Figure 8:
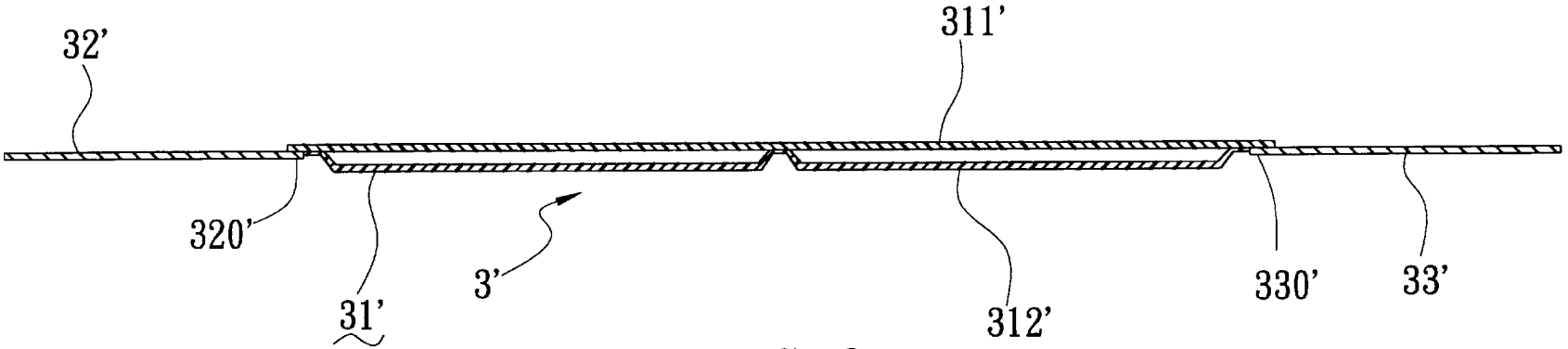
FIG. 8 is a sectional view of the second preferred embodiment of a loose-leaf card holder according to the present invention.

Referring to FIG. 8, the second preferred embodiment of a loose-leaf card holder 3' according to the present invention is shown to also comprise a holder body 31' and left and right note writing flaps 32', 33' connected to lateral left and right sides of the holder body 31'. However, unlike the previous embodiment, the lateral left and right edges of the front sheet 312' and the connecting portions 320', 330' of the note writing flaps 32', 33' are heat-sealed directly to the lateral left and right edges of the backing sheet 311' on the same surface of the backing sheet 311'.

Figure 9:
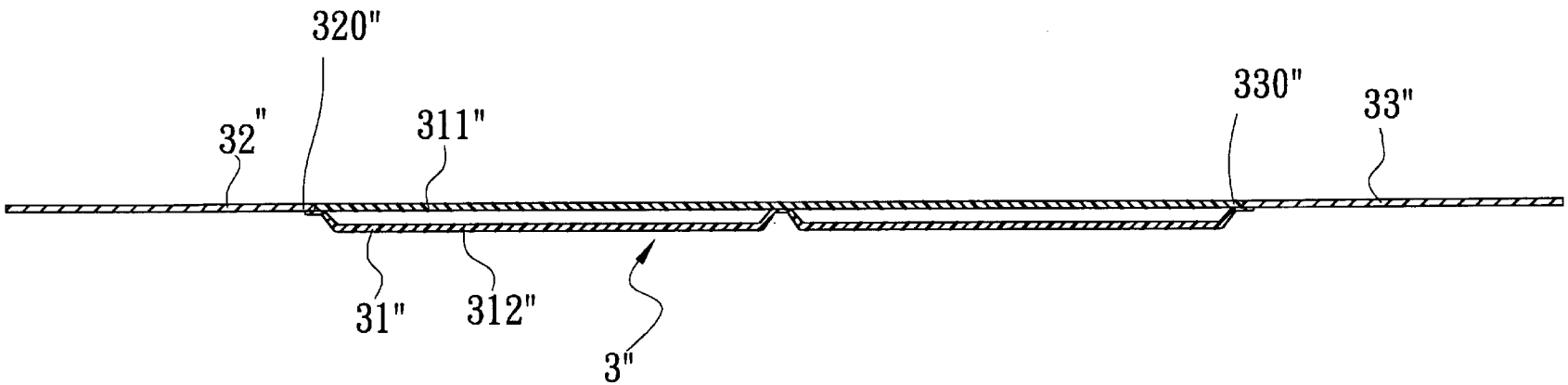
FIG. 9 is a sectional view of the third preferred embodiment of a loose-leaf card holder according to the present invention.

Referring to FIG. 9, the third preferred embodiment of a loose-leaf card holder 3" according to the present invention is shown to also comprise a holder body 31" and left and right note writing flaps 32", 33" connected to lateral left and right sides of the holder body 31". However, unlike the previous embodiments, the lateral left and right edges of the front sheet 312" extend beyond the lateral left and right edges of the backing sheet 311" and have the connecting portions 320", 330" of the note writing flaps 32", 33" respectively and sealingly connected thereto.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A loose-leaf card holder adapted for holding a plurality of cards therein, comprising:

a holder body having a pair of lateral sides and a pair of transverse sides, and including a backing sheet and at least one front sheet, said backing sheet and said front sheet being made from a transparent plastic fusible material, said front sheet having opposite transverse edges and opposite lateral edges, said lateral edges and a first one of said transverse edges being connected sealingly to one surface of said backing sheet such that said front sheet and said backing sheet cooperatively form a pouch unit, said front sheet being further connected to said backing sheet along a heat-sealed seam unit that is transverse to said transverse edges and that divides said pouch unit into at least two card receiving spaces, a second one of said transverse edges of said front sheet further cooperating with said backing sheet to form each of said card receiving spaces with an open access end such that the cards can be inserted into said card receiving spaces via said open access ends; and first and second note-writing flaps connected respectively to said holder body at one of said pairs of lateral and transverse sides of said holder body, each of said first and second note-writing flaps having a note writing portion adapted for writing notes thereon, and a connecting portion that extends from said note writing portion and that is connected to said holder body, said first note-writing flap further having a binding portion that extends from said note writing portion in a direction opposite to said connecting portion thereof and that is formed with a set of binding holes.

2. The loose-leaf card holder as claimed in claim 1, wherein said connecting portion of each of said first and second note-writing flaps is disposed between and is connected sealingly to said backing sheet and one of said lateral edges of said front sheet.

3. The loose-leaf card holder as claimed in claim 1, wherein said connecting portions of said first and second note-writing flaps and said lateral edges of said front sheet are connected directly and sealingly to said surface of said backing sheet.

4. The loose-leaf card holder as claimed in claim 1, wherein said lateral edges of said front sheet extend beyond lateral edges of said backing sheet and have said connecting portions of said first and second note-writing flaps respectively and sealingly connected thereto.

5. The loose-leaf card holder as claimed in claim 1, wherein said first and second note-writing flaps are made from a plastic synthetic paper material and are connected sealingly to said holder body.

* * * * *